US012421943B2

(12) United States Patent
Kantor et al.

(10) Patent No.: US 12,421,943 B2
(45) Date of Patent: Sep. 23, 2025

(54) PISTON COMPRESSOR HAVING ECCENTRIC LIFTING ELEMENT

(71) Applicant: KNORR-BREMSE Systeme fuer Nutzfahrzeuge GmbH, Munich (DE)

(72) Inventors: Kornel Kantor, Kecskemet (HU); Peter Kovacsik, Budapest (HU); Zoltan Laszlo Vass, Kecskemet (HU); Yves Compera, Garching bei Munchen (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 18/561,344

(22) PCT Filed: May 25, 2022

(86) PCT No.: PCT/EP2022/064304
§ 371 (c)(1),
(2) Date: Nov. 16, 2023

(87) PCT Pub. No.: WO2022/248605
PCT Pub. Date: Dec. 1, 2022

(65) Prior Publication Data

US 2024/0229781 A1 Jul. 11, 2024

(30) Foreign Application Priority Data

May 25, 2021 (EP) ..... 21175774

(51) Int. Cl.
*F04B 1/0413* (2020.01)
*F04B 9/04* (2006.01)
(Continued)

(52) U.S. Cl.
CPC ..... *F04B 1/0413* (2013.01); *F04B 9/042* (2013.01); *F04B 27/0414* (2013.01); *F04B 35/01* (2013.01)

(58) Field of Classification Search
CPC ..... F04B 1/0413; F04B 9/042; F04B 9/045; F04B 27/0414; F04B 35/01; F04B 27/0538; F04B 27/0536; F04B 39/0094
See application file for complete search history.

(56) References Cited

U.S. PATENT DOCUMENTS 3,204,563 A 9/1965 Eickemeyer
3,659,502 A 5/1972 Friedman et al.
(Continued)

FOREIGN PATENT DOCUMENTS

DE 10 2008 022 604 A1 11/2009
DE 10 2018 111 059 A1 11/2019
(Continued)

OTHER PUBLICATIONS

International Search Report (PCT/ISA/210) issued in PCT Application No. PCT/EP2022/064304 dated Aug. 22, 2022 (3 pages).
(Continued)

*Primary Examiner* — Bryan M Lettman
(74) *Attorney, Agent, or Firm* — Crowell & Moring LLP

(57) ABSTRACT

A piston compressor has a piston guided in a compressor cylinder, wherein the piston and the compressor cylinder form a compressor chamber for compressing a fluid. A shaft is provided that rotates around its axis. A lifting element is arranged eccentrically to the axis of the shaft and is provided fixed to the shaft. The lifting element and the piston are configured in such way that the piston performs a movement between a maximum and a minimum lifting position when the shaft rotates around its axis.

15 Claims, 7 Drawing Sheets

(51) Int. Cl.
*F04B 27/04* (2006.01)
*F04B 35/01* (2006.01)

(56) References Cited

U.S. PATENT DOCUMENTS

| | | | | |
|---|---|---|---|---|
| 5,076,057 | A | 12/1991 | Maruno | |
| 5,195,420 | A * | 3/1993 | Wanner | F16C 3/12 123/54.2 |
| 6,132,177 | A | 10/2000 | Loprete et al. | |
| 2002/0038554 | A1 | 4/2002 | Monk et al. | |
| 2003/0062205 | A1* | 4/2003 | Konrad | F04B 35/002 180/65.245 |
| 2010/0158715 | A1 | 6/2010 | Wang | |
| 2011/0280754 | A1* | 11/2011 | Chang | F04B 1/0413 417/510 |
| 2012/0315176 | A1* | 12/2012 | Ogawa | F04B 1/0474 418/151 |
| 2014/0170006 | A1 | 6/2014 | Bergman et al. | |
| 2016/0305421 | A1 | 10/2016 | Li et al. | |

FOREIGN PATENT DOCUMENTS

| | | | |
|---|---|---|---|
| JP | 10-246184 | A | 9/1998 |
| JP | 2004-301069 | A | 10/2004 |
| JP | 2006-526112 | A | 11/2006 |
| JP | 2012-2225 | A | 1/2012 |
| JP | 2017-501341 | A | 1/2017 |
| JP | 2019-157636 | A | 9/2019 |

OTHER PUBLICATIONS

Written Opinion (PCT/ISA/237) issued in PCT Application No. PCT/EP2022/064304 (9 pages).
Extended European Search Report issued in European Application No. 21175774.5 dated Oct. 18, 2021 (10 pages).
European Office Action issued in European Application No. 21175774.5 dated Aug. 23, 2023 (4 pages).
Japanese-language Office Action issued in Japanese Application No. 2023-572860 dated Nov. 5, 2024 with English translation (19 pages).
Japanese-language Office Action issued in Japanese Application No. 2023-572860 dated Apr. 22, 2025 with English translation (4 pages).
Korean-language Office Action issued in Korean Application No. 10-2023-7044698 dated Jun. 20, 2025 with English translation (16 pages).

* cited by examiner

PISTON COMPRESSOR HAVING ECCENTRIC LIFTING ELEMENT

BACKGROUND AND SUMMARY

The current invention relates to a piston compressor.

Piston compressors comprise one or more piston(s) each guided in a compressor cylinder wherein the piston and the compressor cylinder form a compressor chamber for compressing a fluid. During operation of the compressor, the piston is moved along the axis of the compressor cylinder between a maximum and a minimum lifting position, wherein the compressor chamber comprises its smallest volume when the piston is in the maximum lifting position and wherein the compressor chamber comprises its maximum volume when the piston is in the minimum lifting position. Preferably, the fluid to be compressed is supplied to and ejected from the compressor chamber via ports controlled by valves.

The piston compressor according to the invention works according to this principle.

Vehicles, in particular commercial vehicles, require supply of compressed fluids, in particular compressed air, for different systems of the vehicle. For example, the air is required for a fuel cell of the vehicle or stored in a compressed air reservoir of a pneumatic braking system or of a pneumatic air suspension and/or further consumers. The compressed air is in particular generated by a piston compressor as described above.

Since the installation space of a vehicle is limited, the current invention has the object to reduce the required installation space for a piston compressor by reducing its extension in at least one direction. A further task of the invention is to reduce the complexity of the design of a piston compressor.

These tasks are solved by the subject-matter of the independent claims. Advantageous embodiments are the subject-matters of the dependent claims.

According to the invention, a piston compressor is provided, comprising:

- a piston guided in a compressor cylinder wherein the piston and the compressor cylinder form a compressor chamber for compressing a fluid;
- a shaft that rotates around its axis; and
- a lifting element arranged eccentrically to the axis of the shaft and provided fixed to the shaft, wherein
- the lifting element and the piston are configured in such way that the piston performs a movement between a maximum and a minimum lifting position when the shaft rotates, in particular performs a full rotation, around its axis.

The expression "a movement" is in particular to be understood to mean "at least one movement". Preferably, the piston performs two movements between a maximum and a minimum lifting position when the shaft performs a full rotation, around its axis, for example from the maximum position to the minimum position and from the minimum position back to the maximum position.

In particular, due to the eccentric arrangement of the lifting element with respect to the axis of the shaft, the lifting element performs a lifting movement, which is transmitted to the piston.

Preferably, the lifting element comprises a cylindrical element, wherein the axis of the cylindrical element is arranged eccentrically to the axis of the shaft. Preferably, to reduce weight, the lifting element does not comprise a massive cylindrical element. For example, the cylindrical element comprises an inner ring through which the shaft extends and an outer ring, which is arranged eccentrically to the inner ring. Both rings can be connected via elements extending radially outwards from the inner to the outer ring. The cylindrical element can be configured as a disc, wherein the height of the cylindrical element is smaller than the radius of the cylindrical element so as to reduce the extension of the compressor in the direction of the axis of the shaft. The disc or cylinder shape of the lifting element is of particular advantage as it allows to couple the mounting portion of a connecting rod with the lifting element via relatively large roller bearings which are more resistant to heat and torque variations than small roller bearings, as for instance used in case of the lifting elements being realized by crank pins being connected with the shaft by crank shoulders.

In general, the lifting element can also comprise elements with other shapes as long as the piston can be lifted by transmitting the lifting movement of the lifting element to the piston. In particular, the lifting element can comprise a partially cylindrical element.

Preferably, the lifting element and the piston are directly connected to each other or via intermediate elements.

Preferably, the compressor comprises at least one further piston guided in a further compressor cylinder. Particularly preferred, the compressor comprises at least two further pistons, preferably between two and eight, more preferably between two and five, even more preferably exactly two or five, most preferably exactly two, further pistons, wherein each further piston is guided in a further compressor cylinder. In other words, the compressor preferably comprises in total between three and nine, preferably between three and six, more preferably exactly three, six or nine, most preferably exactly three, pistons, each of which is guided in a compressor cylinder. It turned out that in particular the use of three pistons is of particular advantage as it allows arranging the pistons in an angular arrangement in the form of an Y-Arrangement. The Y-Arrangement turned out to be of particular advantage with respect to the reduction of noise and vibration emissions of the compressor. This makes the compressor particularly suitable as an air compressor, in particular as an air compressor for a braking system, in particular for a braking system of a vehicle, in particular of a commercial vehicle or a rail vehicle.

Where features are subsequently described with respect to the compressor cylinder and the further compressor cylinder or to the piston and the further piston, the respective feature is intended to equally apply to the preferred embodiments with at least two further pistons and cylinders, preferably between two and eight, more preferably between two and five, even more preferably exactly two or five, most preferably exactly two, further pistons and cylinders. In addition to this statement, this is additionally indicated by the end "/s" behind the wording "additional piston" or additional "cylinder".

Preferably, the compressor cylinder and the further compressor cylinder/s are arranged to each other in an overlapping manner, i.e. in such way that the distance between the axles of the compressor cylinder and the further compressor cylinder/s, in particular between adjacent cylinders, in the direction of the axis of the shaft is smaller than the sum of the outer radiuses of the outer dimension of the compressor cylinder and the further compressor cylinder. Consequently, the compressor cylinders cannot be arranged in a row, wherein the extension of the compressor in the direction of the axis of the shaft is reduced. Additionally or alternatively, preferably additionally, the compressor cylinder and the further compressor cylinder/s are arranged in such way that the axles of the cylinder/s are spaced from each other in the direction of the axis of the shaft. Additionally or alternatively, preferably additionally, the compressor cylinder and the further compressor cylinder/s are arranged to each other in an such a way that the distance between the axles of the compressor cylinder and the further compressor cylinder/s, in particular between adjacent cylinders, in the direction of the axis of the shaft, is larger than the extension of an, in particular of each, intermediate element, in particular of a connection rod, coupling the piston with the shaft. This allows to couple each piston via an individual lifting element or lifting element section, and preferably an individual connection rod and preferably individual bearing means, in particular roller bearings, to the shaft. Thanks to the space between the cylinders in the direction of the axis of the shaft, the pistons can be coupled to the shaft by roller bearings. This allows, contrary to oil lubricated bearings, to realize the bearing in the crank case oil free which allows to suck the air to be compressed by the compressor from the inside of the crank case without risking to contaminate the air with oil. Further, thanks to the space between the cylinders in the direction of the axis of the shaft, it is possible to use relatively large pistons and/or to increase the resistance of the compressor to heat and torque variations which particularly qualifies the compressor as an air compressor, in particular as an air compressor for a braking system, in particular for a braking system of a vehicle, in particular of a commercial vehicle or a rail vehicle. In particular in combination with the subsequently described preferred angular arrangement and the previously described small space in the direction of the axis, this allows providing a small size compressor with increased resistance to heat and torque variations.

Preferably, each piston is coupled with the shaft by a lifting element, preferably by a connecting rod. Preferably, each connecting rod is connected with its piston, particularly preferred by oil-free bearing means, such as ball bearings. Additionally or alternatively, each connecting rod is coupled with the shaft via, in particular own, bearing means, in particular oil-free bearing means, particularly preferred roller bearings. Preferably, each connecting rod is coupled to the lifting element via an own lifting element or an own lifting element section. Preferably, the piston compressor comprises one lifting element or lifting element section for each piston, in particular one disc shaped lifting element or lifting element section for each piston, wherein the lifting element or lifting element section and the piston are configured in such way that the piston performs a movement between a maximum and a minimum lifting position when the shaft rotates around its axis.

Preferably, the compressor cylinder and the further compressor cylinder/s are arranged in an angular arrangement, wherein the angle between the axles of the compressor cylinders is between 0° and 180°, in particular between more than 0° and 180°, preferably between 10° and 160°, more preferably between 30° and 140°, most preferably between 60° and 120°, similar to a V-engine, a Boxer-engine or to a radial engine. Preferably, the compressor cylinder and the at least two further compressor cylinders are arranged in an angular arrangement in that each of their axles has a different angle with respect to a reference angular position. Particularly preferred, the compressor cylinder and the at least two further compressor cylinders are arranged in an angular arrangement in that the largest angular space between two of their axis being adjacent to each other in circumferential direction is between 10° and 160°, preferably between 30° and 140°, more preferably between 60° and 120°, even more preferably 60° or 120°, most preferably 120°. Preferably, the compressor cylinder and the at least two further compressor cylinders are arranged around the shaft in a star-arrangement, preferably in a Y-arrangement, preferably wherein the angular space between the legs of the star-arrangement or the Y-arrangement is between 10° and 160°, preferably between 30° and 140°, more preferably between 60° and 120°, even more preferably 60° or 120°, most preferably 120°.

According to one advantageous embodiment of the invention characterized by a smooth and balanced running of the compressor, the compressor comprises three or six compressor cylinders spaced by 120° or 60° to each other.

In an advantageous embodiment, the axles of the compressor cylinder and of the further compressor cylinder are arranged in the same plane, wherein the axis of the shaft is oriented perpendicular to this plane. This leads to a compressor, which comprises a reduced extension in the direction of the axis of the shaft.

According to an alternative embodiment, if the extension of the compressor transverse to the axis of the shaft shall be reduced, the compressor cylinder and the further compressor cylinder can be arranged in a row as well.

The angular and the row arrangement of the compressor cylinders can be combined as well. For example, at least two compressor cylinders can be arranged in a row along the axis of the shaft, wherein at least two further compressor cylinders are arranged in a further row, wherein both rows are arranged in an angular arrangement around the axis of the shaft.

In general, the compressor can comprise more than just one further compressor cylinder. Preferably, the compressor comprises three compressor cylinders, wherein the angle between the axles of the compressor cylinders around the axis of the shaft is 120°. In another embodiment, the compressor comprises six compressor cylinders, wherein the angle between the axles of the compressor cylinders around the axis of the shaft is 60°, i.e. like a V-engine or a radial engine.

Preferably, the at least one further piston/s is/are connected directly or via intermediate elements to the lifting element in such way that the at least one further piston/s is configured to perform a movement between a maximum and a minimum lifting position when the shaft rotates, in particular performs a full rotation, around its axis. Preferably, the extension of the lifting element in the direction of the axis of the shaft is chosen in that each of the pistons can be connected to the lifting element, wherein the position of the axles of the pistons are spaced from each other in the direction of the axis of the shaft. Particularly preferred, the extension of the lifting element is at least as large, preferably larger, as the sum of the extension of the intermediate elements of the pistons.

Preferably, the shaft has a cylindrical shape. Particularly preferred, the lifting element has a hollow cylindrical shaped, wherein the inner diameter of the hollow cylinder corresponds to the outer diameter of the shaft and wherein the outer diameter of hollow cylinder corresponds to an inner diameter of bearing means, in particular of roller bearings, for coupling the lifting element with the intermediate elements, in particular connecting rods. Preferably, the extension of the lifting element is eccentrically provided to the shaft. Preferably, this embodiment is combined with the previously described angular arrangement. Preferably, the lifting element is configured as one piece, in particular is integrally formed, for instance by casting.

In particular, the intermediate element, preferably each intermediate element, is a connecting rod. Preferably, the connecting rod, in particular each connecting rod, comprises a mounting portion for coupling the connecting rod with the shaft, in particular crank shaft, and a rod portion for coupling, in particular connecting, the connecting rod with a piston. The mounting portion can be configured to realize the coupling with the shaft in various ways. For instants, the mounting portion can comprise a bore being configured to receive a crankpin which is connected via crank shoulders to the shaft. However, the inventors have found that it is advantageous to realize the coupling of the connecting rod with the shaft by a bore being configured to receive the shaft. Particularly preferred, the bore is configured to receive the shaft and an eccentric. Preferably, the eccentric is rotationally symmetrically shaped, in particular disc shaped, or cylindrically shaped. In particular, the bore of the mounting portion has a diameter corresponding to sum of the extension in radial direction of the eccentric and bearing means between the eccentric and the mounting portion. Particularly preferred, the bearing means comprise a roller bearing.

The rod portion can be configured to realize the coupling with the piston in various ways. "Coupling" particularly means that force can be transmitted from the connecting rod to the piston and vice versa. It does not require the piston and the connecting rod to be separate parts. To the contrary, the piston and the rod portion or at least a part of the rod portion, preferably a piston facing section of the rod portion, can be configured as one piece or as separate pieces (parts). Preferably, they are configured as one piece, in particular are integrally formed, for instance by casting and/or are free of joints between them. Alternatively, the piston and the connecting rod can be made from two pieces and can be connected with each other by connecting means allowing a rotational movement between the rod portion and the piston (rotatable connection) or prohibiting such movement (fixed connection). For the rotatable connection, wrist pin bearings can be used as connecting means. Such wrist pin bearings can be realized by a wrist pin being connected with the rod portion and a corresponding receiving portion, in particular a bore, of the cylinder or vice versa. For the fixed connection, the connecting means can comprise a bore extending from the piston into the rod portion. Inside the piston and inside the rod portion, a threading can be provided for fixing both parts which each other by a screw. Alternatively, a second bore can be provided for instance one bore in the piston and one bore in the rod portion so that a screw can be inserted via one of the bores and a threaded nut via the other one of the bores for connecting both parts which each other. Particularly preferred, one bore can extend in radial direction through the piston, in particular from the face of the piston facing the cylinder in radial direction to the rod portion. The bore in the rod portion can extend orthogonal to the bore in the piston. In the case of the previously described preferred one piece configuration of the piston and the rod portion, the previously described bores can advantageously be used to connect a valve, in particular a reed valve, with the piston, in particular to allow sucking air via the piston from the inside of the crank case.

Alternatively, this embodiment allows an arrangement of two or more compressor cylinders in the same plane, i.e. in an angular arrangement of 180° if two compressor cylinders are provided, wherein the axis of the shaft is oriented perpendicular to this plane. Further, even more compressor cylinders can be arranged in the same plane by connecting them to the same lifting element.

Preferably, the further comprises a split crank case with two separate parts being connectable with each other, in particular by screw means, along a connecting surface in that, before connecting the separate parts with each other, a mounting opening being delimited by the connecting surface is dimensioned in that a pre-assembled crank drive comprising the shaft, the lifting element, in particular the lifting element previously our subsequently described lifting element/s, and the piston, preferably each of the piston and the at least one additional piston/s, can be inserted via the mounting opening into one of the separate parts. This can for instance be realized in that the connecting surface extends in the direction, in particular parallel to the direction, of the axis of the shaft, preferably in that at least one of the cylinders is coupled to one of the separate parts while the remaining cylinder/s are connected to the other part. Alternatively, this can be realized in that the connecting surface extends angled, in particular perpendicular, to the axis of the shaft, in particular in that the connecting surface cuts each cylinder opening in the crank case of each cylinder into two parts.

Due to the previously described split crank case, the crank drive can be completely pre-assembled outside the crank case in that the pistons are already coupled with the shaft. This allows to provide a proper fitting between the parts of the crank drive which makes the compressor particularly suitable for as air compressor, in particular as air compressor for a braking system, in particular for a braking system of vehicle, in particular of a commercial vehicle or a rail vehicle. In particular in combination with the previously described angular arrangement and the previously described small space in the direction of the axis, this allows providing a small size compressor with increased resistance to heat and torque variations.

Alternatively, the at least one, preferably each, further piston/s of the one further compressor cylinder/s is/are connected directly or via intermediate elements to a further lifting element, in particular to a further lifting element for each piston, arranged on the shaft in such way that the at least one further piston/s is/are configured to perform a movement between a maximum and a minimum lifting position when the shaft rotates, in particular performs a full rotation, around its axis.

Preferably, each of the lifting element and the further lifting element/s is configured as a separate piece, wherein the lifting elements and the shaft are connected with each other in a torque transmitting manner by a connecting force acting in the direction of the axis of the shaft, preferably wherein the force is provided by biasing means biasing the shaft and the lifting elements in the direction of the axis of the shaft against each other, preferably wherein the biasing means comprise a threaded nut preferably cooperating with a corresponding thread on the shaft. Particularly preferred, each of the lifting elements, being preferably disc shaped, comprise a bore for receiving the shaft, preferably wherein the bores of each lifting element are aligned to each other in that that the shaft, in particular being cylindrically shaped, can be inserted in the direction of the axis of the shaft through the bores, in particular wherein each lifting element is already preassembled in a crank case of the compressor in that they are already coupled with the pistons. Preferably an abutment surface protruding in radial direction, with respect to the axis of the shaft, from the shaft is provided to allow transmitting the connecting force from the shaft to the lifting elements.

Due to the fact that the lifting elements are separate elements, they can be individually pre-assembled to the pistons outside of the crank case which allows a strong fitting, in particular press fitting, between the pistons and the lifting elements, particularly preferred between roller bearings connecting the lifting elements with the pistons via the connecting rod. Thanks to the lifting elements being separate parts, they can be inserted, pre-assembled with the piston, into the crank case, in particular via piston openings, in particular bores, in the crank case. This particularly allows to combine the advantages of pre-assembling the pistons and the lifting elements outside of the crank case with a one-piece crank case.

Due to the connection of the shaft with the lifting elements in a force transmitting manner by a connecting force acting in the direction of the shaft, the lifting elements can be preassembled in a one peace crank case in that they are already coupled with the pistons, which are preferably already assembled in their cylinders, wherein the crank shaft can be inserted through their aligned bores in the direction of the axis of the shaft. The torque transmission from a motor, in particular electric motor, to the shaft can be provided by coupling, for instance by a clutch, or by directly mounting the shaft of the compressor to a shaft of the motor. An advantage of the previously described design is that the orientation of the lifting elements in circumferential direction, with respect to the axis of the shaft, can be chosen freely.

Preferably, the lifting elements are arranged eccentrically to the axis of the shaft, and are preferably provided fixed to the shaft, wherein the lifting elements are aligned with each other in that an angle between the lifting elements, in particular between the symmetry axis of the lifting elements, is less than 180°, preferably less than 90°, more preferably less than 60°, even more preferably less than 30°, most preferably less than 10°, in particular in that the lifting elements are arranged in a row, in particular in that they share one common symmetry axis. In the preferred case, where the lifting elements are disc shaped, the symmetry axis particularly relates to the rotation symmetry axis of the lifting elements. The lifting elements being arranged eccentrically to the axis of the shaft particularly means that their symmetry axis is spaced in radial direction, with respect to the axis of the shaft, from the axis of the shaft.

Preferably, the lifting element and the further lifting element/s are arranged so that they abut to each other in the axial direction of the shaft. Advantageously, this leads to a reduction of the extension of the compressor in the direction of the axis of the shaft. For example, at least one lifting element comprises a sleeve to be mounted on the shaft, wherein the shaft abuts to the other lifting element/s.

Preferably, a space is provided between the lifting element and the further lifting element/s, in particular for cooling. As the lifting elements comprise permanent lubricated bearings, cooling is essential to avoid overheating of the lubricant and therefore to avoid the lubricant flowing out of the bearings.

Preferably, the lifting element, preferably each of the previously described lifting elements, and the shaft are configured as one piece, for instance by casting. Preferably, the shaft has a cylindrical shape. Additionally or alternatively, the lifting element, particularly each lifting element, has a disc or a cylindrical shape.

Preferably, the piston, in particular each piston, is connected to the lifting element, in particular to an own lifting element or lifting element section, via a connection rod.

Preferably, the lifting element, in particular each lifting element, comprises a circular disc, which is eccentrically provided to the shaft regarding its axis.

Preferably, a roller bearing or a slide bearing is provided between the lifting element, in particular each lifting element, and the piston, in particular each piston, in particular between the lifting element and an intermediate element e.g. a connection rod. In particular, the bearing can be formed by the lifting element and a connection element surrounding the lifting element, wherein between both elements a space is formed containing roller elements such as balls or needles for forming a roller bearing. For forming a slide bearing, the space between the lifting element and the connection element is configured that both elements can slide on each other. In every embodiment the space can comprise a lubricant, in particular a permanent lubricant.

Preferably, the fluid is a gas, in particular air, or a liquid, in particular a hydraulic liquid.

Preferably, the compressor comprises more than one lifting element, wherein at least one lifting element is configured as described above.

The lifting elements can be provided eccentrically to the axis of the shaft, wherein the centres of each lifting element can be provided in an angular arrangement around the axis of the shaft, wherein the angle between each centre is between 0° and 180°. According to a preferred embodiment, the eccentric lifting elements have the same angular orientation or they are connected together forming one single lifting element.

According to one embodiment of the invention, the compressor is configured as a multi-tumble-piston-compressor. To meet low vibration requirements and to minimize reciprocating like noise multiple compressor cylinders are preferred. Therefore, in particular the compressor can comprise three, four, five, six, seven, eight or more compressor cylinders, further preferably arranged in a radial engine like arrangement. But even two or one or more than eight compressor cylinders are possible as well.

According to a further aspect of the invention, a vehicle is provided comprising a compressor as described above.

Preferably, the compressor is configured to supply air to at least one of these systems of the vehicle:

a fuel cell,
a pneumatic braking system,
an air suspension,
a compressed air reservoir.

Preferably, the vehicle is configured as a commercial vehicle, a truck, a trailer, a passenger car, and/or a combination of a towing vehicle and a trailer.

Additionally or alternatively, the vehicle is configured as an electric, hybrid or conventional vehicle. As an electric or hybrid vehicle, the vehicle can be driven by a fuel cell based system and/or by a battery system.

In particular, the compressor can act as an air supply unit, preferably exclusively, for a trailer, wherein the compressor is installed in the trailer or in a corresponding towing vehicle.

In the following, some preferred embodiments according to the invention are described referring to the drawings.

DETAILED DESCRIPTION OF THE DRAWINGS

Figure 1B:
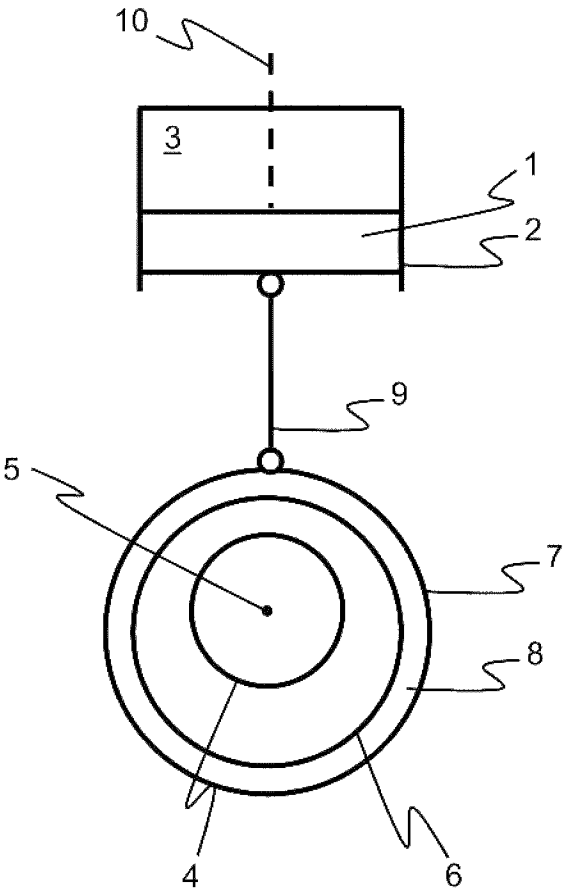
FIG. 1*b* shows the compressor of FIG. 1*a*, wherein the piston is in its minimum lifting position.
Figure 1A:
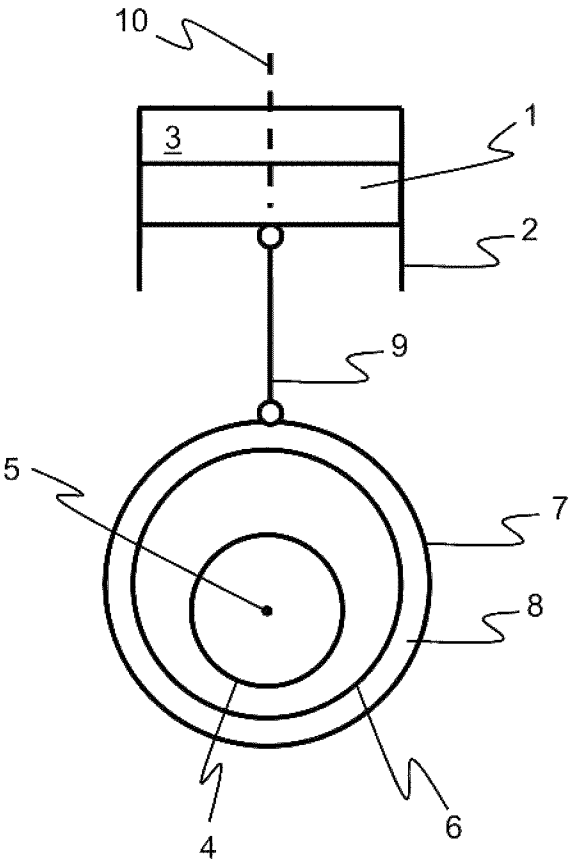
FIG. 1*a* shows a schematic drawing of a piston compressor according to an embodiment of the invention, wherein the piston is in its maximum lifting position.

FIG. 1*a* and FIG. 1*b* are schematic drawings of a piston compressor, wherein the piston is in its maximum lifting position. (FIG. 1*a*) and minimum lifting position (FIG. 1*b*).

A piston 1 is shown which is guided in a compressor cylinder 2. The compressor cylinder 2 extends in the drawing vertically upwards so that its axis 10 is oriented vertically. The piston 1 is movable in the compressor cylinder 2 along the axis 10 from a maximum lifting position as it is shown in FIG. 1*a* to a minimum lifting position as it is shown in FIG. 1*b*. The piston 1 and the compressor cylinder 2 form a compressor chamber 3, wherein a fluid is compressed by the movement of the piston 1.

Further, a shaft 4 is shown extending perpendicularly out of the drawing plane. Consequently, the axis 5 of the shaft 4 extends perpendicularly out of the drawing plane as well. The shaft 4 is configured so as to rotate around its axis 5.

A lifting element 6 is provided on the shaft 4. The lifting element 6 comprises a circular or cylindrical element. The axis of the circular or cylindrical element is oriented in parallel to the axis 5 of the shaft 4 but with an offset to this axis 5. Thus, the lifting element 6 is provided eccentrically to the shaft 4.

When the shaft 4 rotates around its axis 5, the lifting element 6 rotates around this axis as well due to its fixed connection to the shaft 4.

Around the lifting element 6, a connection element 7 is provided. The connection element 7 comprises a circular or cylindrical element coaxially provided to the lifting element 6. The lifting element 6 and the connection element 7 form a space 8 between both elements 6, 7.

The space 8 can be configured in such way, that the lifting element 6 slides on the inner surface of the connection element 7 while the shaft 4 rotates around its axis 5. Therefore, a slide bearing is formed by the lifting element 6, the connection element 7 and the space 8. In this embodiment, a lubricant can be provided in the space 8 to reduce friction between the lifting element 6 and the connection element 7.

In another embodiment, roller elements such as balls or needles, are provided in the space 8. Therefore, a roller bearing is formed by the lifting element 6, the connection element 7 and the space 8 comprising the roller elements. In this embodiment, a lubricant can be provided in the space 8 to reduce friction between the lifting element 6, the roller elements and the connection element 7.

As the lifting element 6 is arranged eccentrically to the axis 5, the lifting element 6 and the connection element 7 perform a lifting movement when the shaft 4 rotates, in particular performs a full rotation, around its axis 5.

To the connection element 7, an intermediate element 9 comprising a connection rod is pivotally attached with one end of the connection rod. The other end of the connection rod is pivotally attached to the piston 1. The intermediate element 9 is configured such that, when the shaft 4 rotates, in particular performs a full rotation, around its axis 5, the intermediate element 9 transmits the lifting movement of the connection element 7 to the piston 1.

This lifting movement can be seen by comparing FIG. 1*a* and FIG. 1*b* showing the piston 1 in the maximum (FIG. 1*a*) and minimum (FIG. 1*b*) lifting position.

Further components of the compressor, in particular ports or valves, are not shown to keep the drawing simple.

The embodiment shown in FIG. 1*a* and FIG. 1*b* represents only one embodiment according to the invention. Further embodiments can be formed by providing more than just one piston. For example, two or more pistons can be arranged around the axis 5 of the shaft 4. Preferably, these pistons are arranged regularly spaced. For example, three or six pistons can be arranged around the shaft 4, in particular spaced by 120° or 60°, respectively.

In the following, several embodiments of a shaft and one or more lifting elements are shown.

Figure 2A:
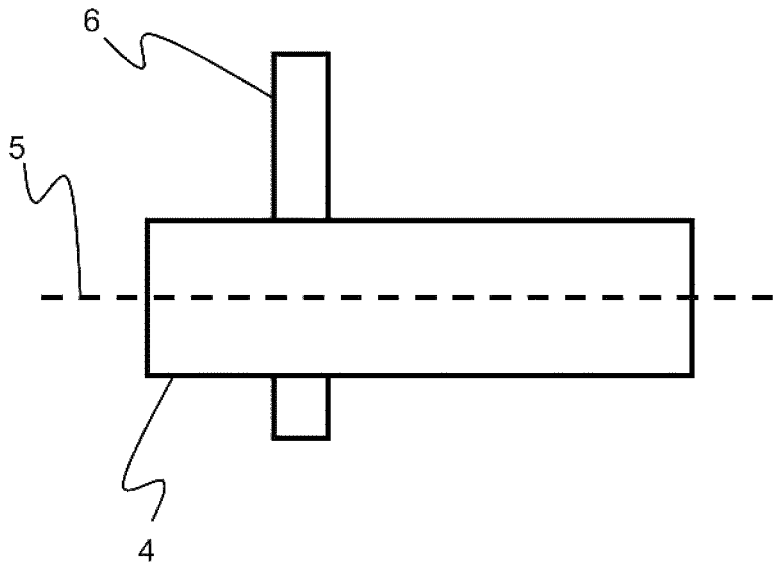
FIG. 2*a* shows another embodiment of a shaft of a piston compressor according to the invention and a lifting element.

FIG. 2*a* shows an embodiment of a shaft of a piston compressor according to the invention and a lifting element.

A shaft 4 with an axis 5 is shown extending from the left to the right. On the shaft 4 a lifting element 6 is provided, which is shown in a section view. The shaft 4 and the lifting element 6 are provided as two separate elements.

The lifting element 6 is provided eccentrically to the axis 5 of the shaft 4 causing the lifting element 6 to perform a lifting movement when the shaft 4 rotates, in particular performs a full rotation, around its axis 5.

Around the lifting element 6 one or more piston(s) can be arranged which are each guided in a compressor cylinder as described above. The pistons can be arranged in the same plane the axis 5 is oriented perpendicular to. That means, each axis of the compressor cylinders can be arranged in this plane.

Figure 2B:
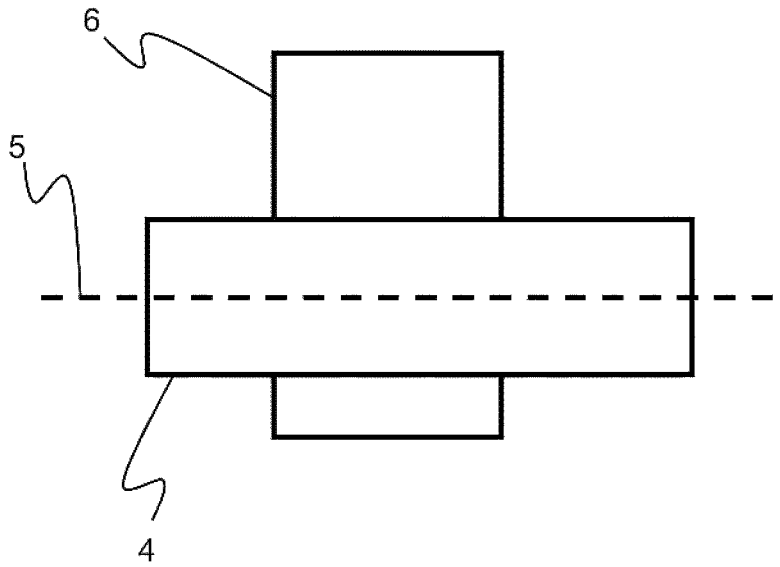
FIG. 2*b* shows another embodiment of a shaft of a piston compressor according to the invention and a lifting element.

FIG. 2*b* shows another embodiment of a shaft of a piston compressor according to the invention and a lifting element.

In contrast to the embodiment shown in FIG. 2*a*, the lifting element 6 comprises a bigger extension in the direction of the axis 5. This allows the arrangement of more pistons in the direction of the axis 5 which can be moved by the one lifting element 6. This allows providing compressor cylinders in a row, wherein the pistons of these cylinders are controlled by the same lifting element 6.

Figure 2C:
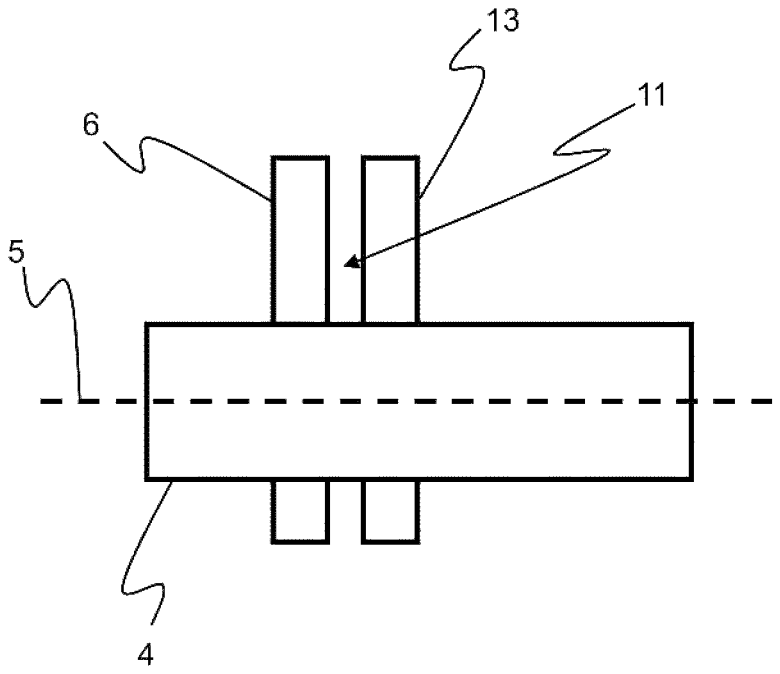
FIG. 2*c* shows another embodiment of a shaft of a piston compressor according to the invention and two lifting elements.

FIG. 2*c* shows another embodiment of a shaft of a piston compressor according to the invention and two lifting elements.

Basically, this embodiment corresponds to the embodiment of FIG. 2*a*, wherein a further lifting element 13 is provided on the shaft 4. Between both lifting elements 6, 13 a space 11 in the direction of the axis 5 is formed. As the lifting elements 6, 13 are connected to the connection element 7 of FIG. 1*a* and FIG. 1*b*, respectively forming a part of a roller or slide bearing, the space 11 is used for cooling the lifting elements 6, 13. In particular, cooling of a permanent lubricant can be ensured and flowing out of the lubricant from the bearings is avoided due to the lubricant getting too fluent.

Figure 2D:
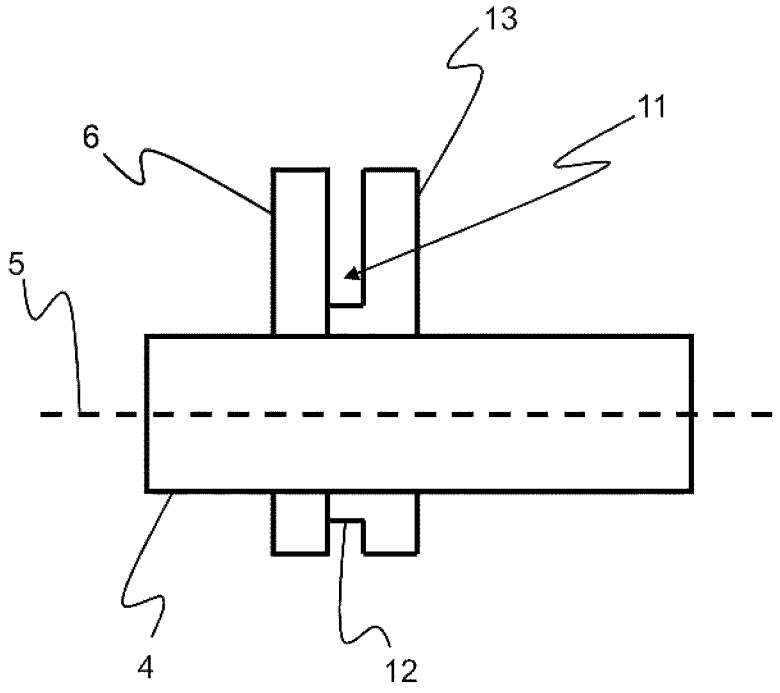
FIG. 2*d* shows a further embodiment of a shaft of a piston compressor according to the invention and two lifting elements.

FIG. 2*d* shows a further embodiment of a shaft of a piston compressor according to the invention and two lifting elements.

This embodiment corresponds to the embodiment shown in FIG. 2*c*, wherein the further lifting element 13 comprises a sleeve 12 the shaft 4 extends through. The sleeve 12 abuts to the lifting element 6. As the part of the further lifting element 13 is thinner than the part comprising the sleeve 12, a space 11 is formed between the lifting elements 6, 13. This space 11 is used for cooling in the same manner as described above with respect to FIG. 2*c*.

Figure 2E:
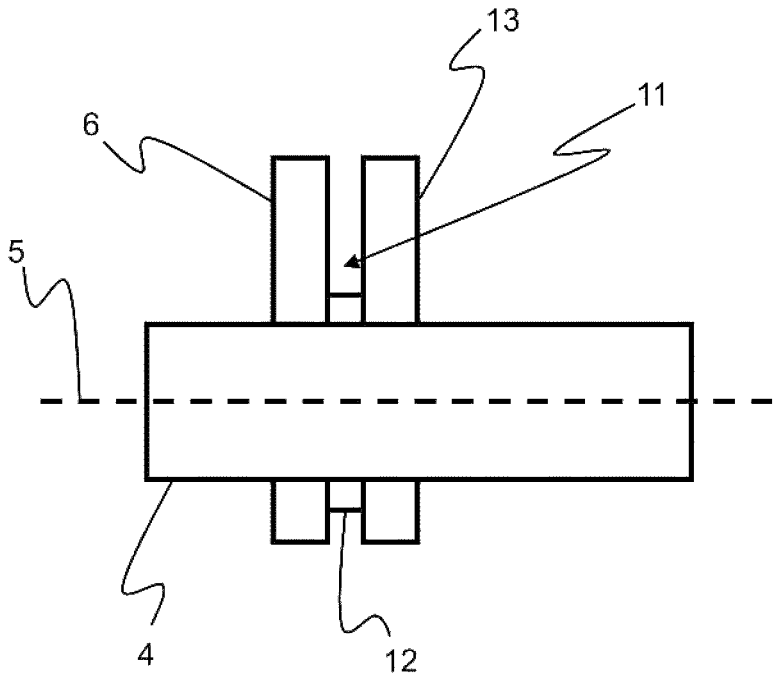
FIG. 2*e* shows another embodiment of a shaft of a piston compressor according to the invention and two lifting elements.

FIG. 2*e* shows another embodiment of a shaft of a piston compressor according to the invention and two lifting elements.

This embodiment corresponds to the embodiment shown in FIG. 2*d*, wherein the sleeve 12 is configured as a separate element. Therefore, manufacturing of the lifting elements 6, 13 and of the sleeve 12 gets easier because the geometry of each element 6, 12, 13 is simplified.

Figure 2F:
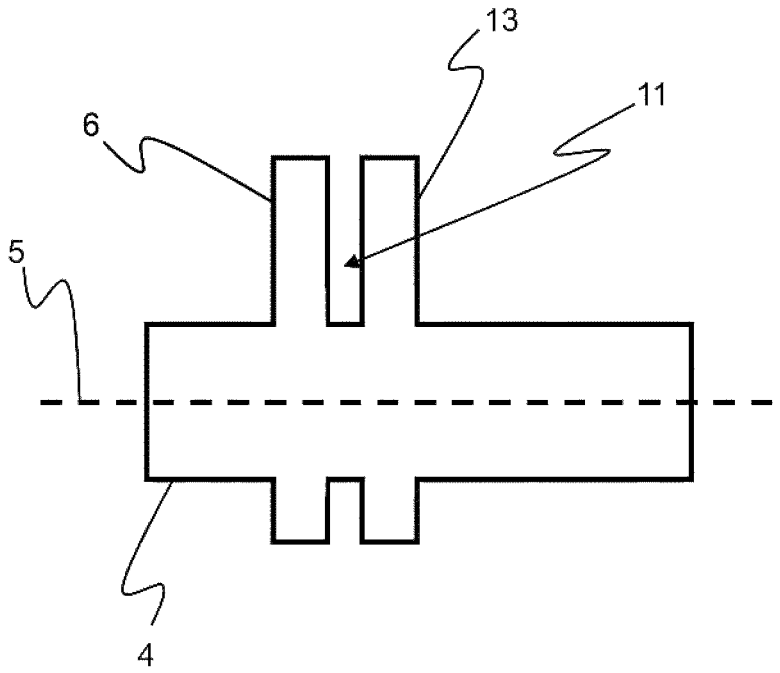
FIG. 2*f* shows another embodiment of a shaft of a piston compressor according to the invention and two lifting elements.

FIG. 2*f* shows another embodiment of a shaft of a piston compressor according to the invention and two lifting elements.

This embodiment essentially corresponds to the embodiment of FIG. 2*c*. In contrast, the lifting elements 6, 13 and the shaft 4 are configured as one piece. Advantageously, the lifting elements 6, 13 do not have to be mounted to the shaft 4 in a separate assembling step.

The embodiments shown in FIG. 1*a*, FIG. 1*b* and FIGS. 2*a* to 2*f* are not limiting of the subject-matter of the invention. Instead, the intention of these drawings is to illustrate some aspects of the invention in more detail. Furthermore, more embodiments can be formed by combining some or all of the shown embodiments.

In the following, FIGS. 3 to 5 will be described in detail, wherein different names might be used for the same parts. For instance, the connecting element 7 may at least partially be referred to as a connecting rod or conrod.

Figure 4:
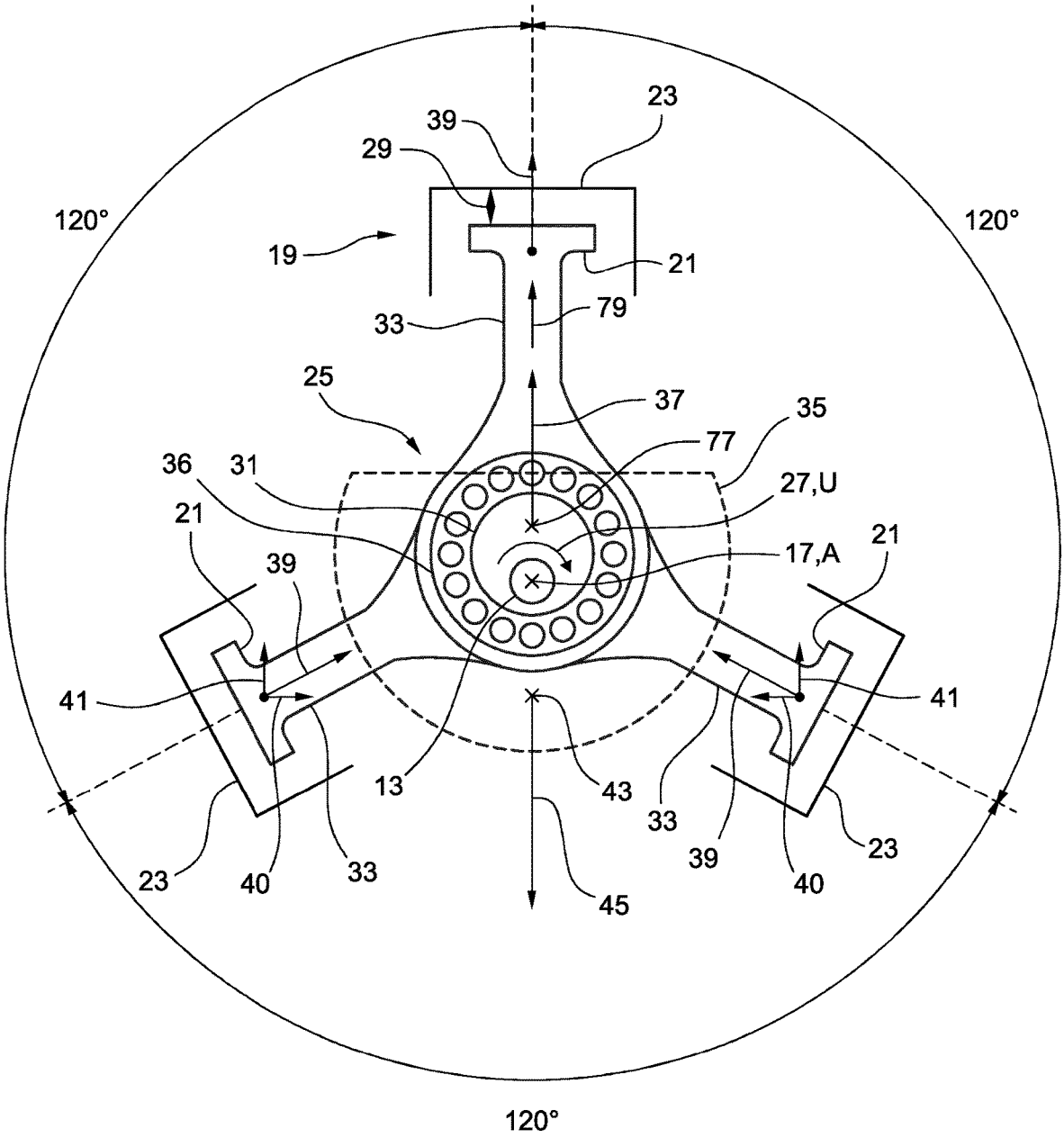
FIG. 4 is a schematic front view of a compressor according to an embodiment of the invention.
Figure 5:
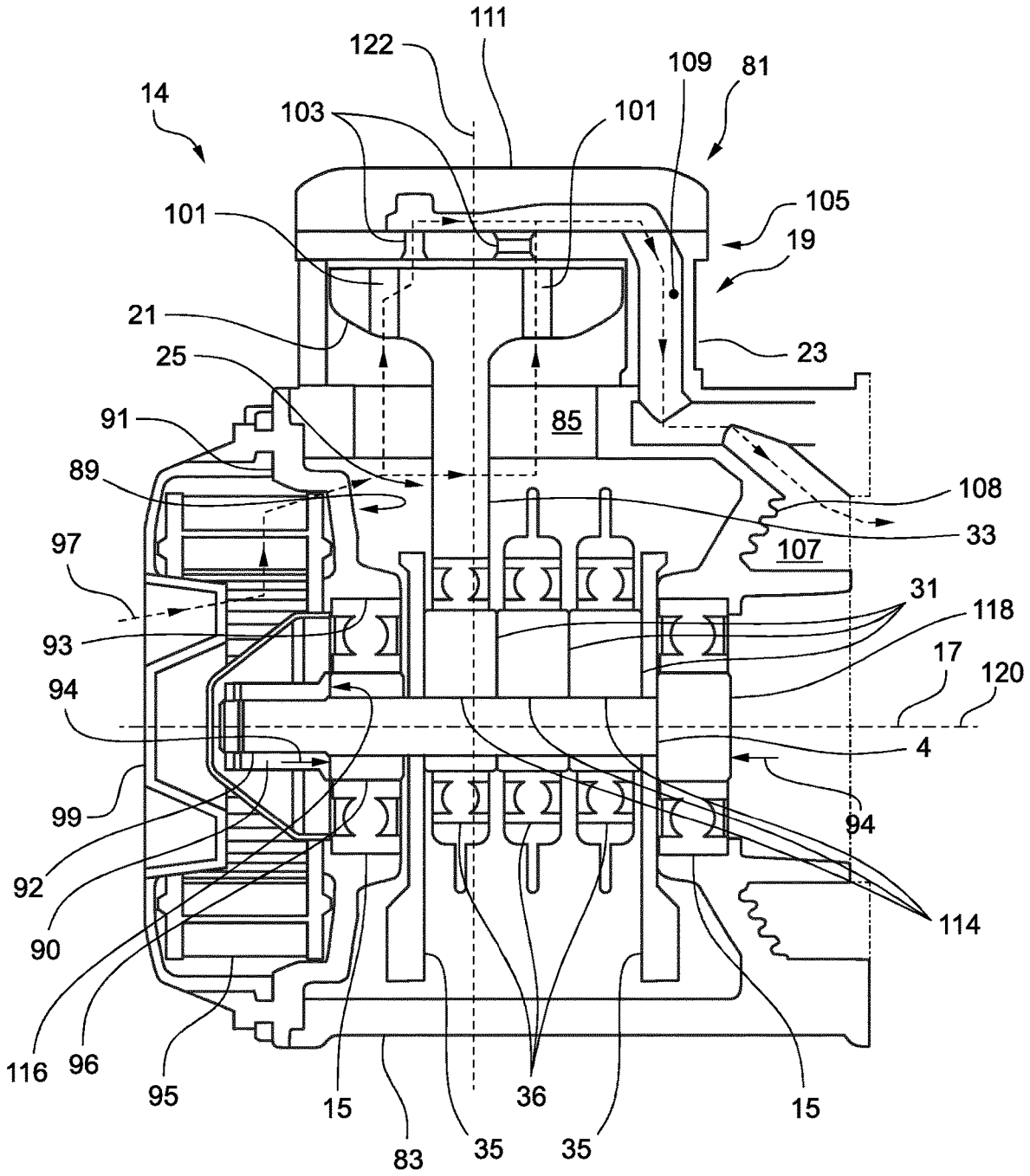
FIG. 5 is a schematic side view of the compressor of FIG. 3 with crank case and air passages.

FIG. 5 schematically illustrates the cross section of a compressor 14, in particular of an air compressor 14. The compressor 14 comprises a shaft 4 being rotatably mounted by roller bearings 15 around a rotation axis 17. The illustrated compressor 14 comprises three compressor units 19, each of which comprises a cylinder 23 and a piston 21. As can be seen by the front view of FIG. 4, the compressor units 19, in particular their pistons 21 and cylinders 23 are spaced from each other in the circumferential direction by 120°. To simplify the illustration, FIG. 5 only shows one compressor unit 19.

The compressor 14 further comprises three crank mechanisms 25 for transforming a rotational movement 27 of the shaft 4 into a reciprocating movement 29 of the piston 21. Each of the crank mechanisms 25 comprise a lifting element 31 in the form of an eccentric 31, in particular of a disc-shaped eccentric 31. Further, each crank mechanism comprises a conrod 33 being coupled with the shaft 4 by a roller bearing 36. The roller bearing 36 surrounds the shaft 4 (crank shaft 4). In particular, the roller bearing 36 is mounted on and surrounds the disc-shaped eccentric 31. The shaft 4 and the eccentrics 31 are surrounded by the roller bearing 36 in circumferential direction U. The axial direction A is indicated with A. The radial direction is indicated with R.

Figure 3:
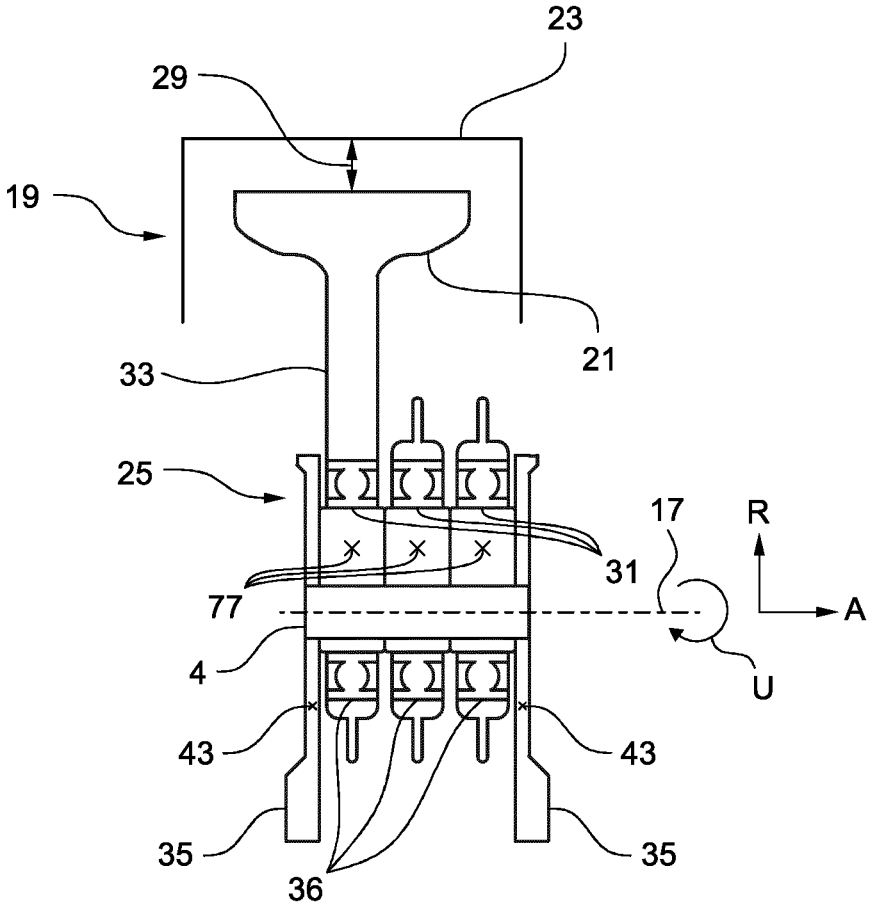
FIG. 3 is a schematic side view of a compressor according to an embodiment of the invention.

As can best be seen in FIGS. 3 and 5, the shaft 4 is free of counterweights and flywheels 35 being mounted in axial direction A between the crank mechanisms 25, in particular between the disc-shaped lifting elements 31 and the conrods 33 being mounted on the lifting elements 31 by roller bearings 36. In particular, the crank mechanisms 25, in particular the lifting elements 31, are located in axial direction A directly next to each other. The lifting elements 31 are realized as eccentrics 31, in particular as disc-shaped eccentrics 31. In the illustrated case, the disc-shaped eccentrics 31 are produced as individual parts with respect to each other and with respect to the shaft. However, the lifting elements 31 are fixedly connected on the shaft 4 in that they rotate with the same rotation speed as the shaft. In the illustrated case, this is realized by a threaded nut 90 which engages a thread 92 on the shaft 4 to connect the lifting elements in a force fitting manner, namely by a compression force 94 acting in axial direction A. In the present case, the compression force 94 compresses the lifting elements 31, the flywheels 35 and a ring shaped shoulder 96 against each other. The ring shaped shoulder 96 provides an abutment surface protruding in radial direction from the shaft to allow transmitting the connecting force from the shaft 4 to the lifting elements 31, in particular from the threaded nut 90 via the ring shaped shoulder 96 through the flywheel 35 to the lifting elements 31. The ring shaped shoulder 96 can be connected to the shaft by any fitting method, in particular by press fitting. Alternatively, the lifting elements 31 and the shaft can be produced from one piece, for instance by casting. Alternatively, only the three lifting elements 31 can be produced as one single piece, in particular in the form of a perforated cylinder having a cylindric bore which is offset from the symmetry axis of the cylinder so that they can act as eccentric. Such perforated cylindrical eccentric 31 could be fixed on the shaft 4 for instance by press fitting.

As can best be seen from FIGS. 3 and 5, the compressor units 19, in particular the middle axis of their pistons 21, and/or the crank mechanisms 25, in particular the lifting elements 31 and the conrods 33, are located in axial direction A between the roller bearings 15. In particular, the roller bearings 15 are spaced from each other in axial direction A to provide a space in between for the compressor units 19, in particular the middle axis of the pistons 21 and the crank mechanisms 25, in particular the lifting elements 31. As can further be seen in FIG. 5, the roller bearings 15 which rotatably mount the shaft 4 are preferably spaced in axial direction A to provide space for the crank mechanisms 25, the compressor units 19 and the flywheels 35 in between the roller bearings 15. In particular, the flywheels 35, the crank mechanisms 35 and the compressor units 19 are located in axial direction between the roller bearings 15 of the shaft 4.

The compressor 14 further comprises two flywheels 35 being configured to counteract mass forces 37, 39, 41, in particular rotating mass forces 37 and alternating mass forces 39, 41, acting on the shaft 4. This is in particular realized by configuring the flywheel in that, in addition to its flywheel function (flattening the torque curve of a compressor), it provides a counterweight function. This is in particular realized by configuring the flywheels 35 in that their centers of gravity 43 are spaced in radial direction R from the rotation axis 17 and positioned in circumferential direction relative to the lifting elements 31, the conrods 33 and the pistons 21 in that the resulting rotating mass force 45 of the flywheels 35 counteract the mass forces 37, 39 and 41 of the lifting elements 31, the conrods 33 and/or the pistons 31. As can be seen in FIG. 3, the center of gravity 43 of the flywheels 35 are aligned with each other in circumferential direction U. In other words, the space of the centers of gravity 43 of the flywheels 35 in circumferential direction U is zero. Additionally, the center of gravity 43 of the flywheels 35 is spaced from the rotation axis 7 of the shaft 4 by the same distance.

The flywheels 35 in FIGS. 3, 4 and 5 are configured to counteract rotating mass forces 37 of the eccentrics 31. This is in particular realized by configuring the flywheels 35 in that their center of gravity 43 is spaced in radial direction R from the rotation axis 17,55 of the shaft 4 and of the flywheel 35, wherein the center of gravity 77 of the eccentrics 31 is spaced from the center of gravity 43 of the flywheel 35 in circumferential direction U by 180°. In other words, the center of gravity 77 of the eccentrics 31 are located in circumferential direction on opposite sides of the rotation axis 17, 55 of the shaft 4 and the flywheel 35. As the flywheel 35 and the eccentrics are coupled with the shaft 4 in that they rotate with the same rotation speed as the shaft, their relative position in circumferential direction U with respect to each other remains constant upon the rotation of the shaft 4. Therefore, the rotating mass forces 37 of the eccentrics 31 act in the opposite radial direction R as the rotating mass forces 45 of the flywheels 35, thereby counteracting each other.

The flywheels 35 are further configured to counteract alternating mass forces 39, 41 of the pistons 21. As can be seen in FIG. 4, each piston 21 causes alternating mass forces 39 which act in a direction parallel to the movement 29 of the piston 21. The alternating mass forces 39 comprise a parallel force component 41 acting parallel to the rotating mass forces 37 of the lifting elements 31 and an orthogonal force component 40 acting orthogonal to the rotating mass forces 37 of the lifting elements 31. The circumferential position of the pistons 21 and of the lifting elements 31 are chosen with respect to each other in that the alternating mass forces 39, 40, 41 of the pistons 21 at least partially compensate each other, in particular in that the orthogonal components 40 at least partially compensate each other. In particular, their circumferential positions are chosen with each other in that the alternating mass forces 39, 40, 41 superimpose each other into a superimposed force 79 with varying amplitudes acting parallel to the rotating mass forces 37 of the lifting elements 31. This is in particular realized by circumferentially offsetting the pistons 21 from each other by 120° into a star arrangement, as shown in FIG. 4 in combination with aligning the centers of gravity 77 and/or the symmetry axis of the eccentrics 31 with each other, as shown in FIG. 4. Based on such superimposed alternating mass force 79, the center of gravity 43 of the flywheels 35 can be spaced from the rotation axis 7 of the shaft 13 in the opposite direction of the superimposed force 79. Thereby, the flywheels 35 can be used to compensate both, the rotating mass forces 37 of the lifting elements 31 and at least a part of the parallel force components 41 of the alternating mass forces 39 of the pistons 21.

FIG. 5 illustrates a preferred embodiment of compressor 14 which sucks air from the inside of the crankcase 81. The crankcase 81 comprises a housing 83 in which the shaft 4, the lifting elements 31 and at least part of the conrods 33 are located. The shaft 4 is rotatably mounted via the roller bearings 15 against the housing 83 and a cover 91 of the crank case 81. The housing 83 comprises one bore 85 for each piston 21 through which the conrod 33 and the piston 21 can protrude out of the housing 83. The crankcase 81 further comprises a cylinder 23 for each piston 21. The cylinder 23 can be located in radial direction R over the bore 85.

The crankcase housing 83 can further comprise a mounting opening 89 for inserting the shaft 4, in particular pre-mounted with the eccentrics 31, in axial direction A into the housing 83. The crankcase 81 further comprise a cover 91 for closing the mounting opening 89 after the shaft 4, and in particular the crank mechanisms and the compressor units are mounted. The shaft 4 can be supported in radial direction R by roller bearing 15 against the cover 91. The cover 91 and the housing 83 both comprise a bore with the same diameter and the same rotation axis, in particular the rotation axis 17 of the shaft, via which the roller bearings 15 are rotatably mounted at the housing 83 and the cover 91.

The compressor 14 further comprise an air-filter 95 for filtering air before entering the crankcase 81. The air-filter 95 is mounted in axial direction A between the cover 91 and a filter cover 99. The air-filter 95 can be hollow cylindrically shaped. The air flow 97 through the compressor 14 is schematically illustrated by reference sign 97. From the left to the right, the air passes through (not shown) openings in the air-filter cover 99 into the inside of the hollow cylindrically shaped air-filter 95 through which the air 97 passes in radial direction R. After leaving the air-filter 95, the filtered air 97 enters the crankcase housing 83 via not shown openings in the cover 91. Subsequently, the air passes through openings (bores) 101 in the piston 21 into the air compression chamber delimited by the piston 21 and the cylinder 23. The cylinder 23 comprises openings (bores) 103 into a discharge-channel system 105. The discharge-channel system 105 comprises a ring shaped air collecting channel 107 in which compressed air from the three compressor units 19 is collected before being guided to an consume of compressed of air, such as a pneumatic braking system. The collecting channel 107 comprises cooling fins 108. The collecting channel 107 is fluidly connected with each of the compressor units 19 by individual discharge channels (lines) 109. The individual discharge channels 109 can be delimited, in radial direction on the inside, by the cylinder 23 and, in radial direction at the outside, by a cylinder cover 111. Further, in particular in the course of the individual discharge channels 109 in radial direction R, the discharge channel 109 can be realized by a bore through the cylinder 23 extending in axial direction of the shaft outside of the compression chamber. Further, the individual discharge channel 109 can and/or the collecting channel 107 can be integrated into the crankcase housing 83.

FIG. 5 illustrates an embodiment of a compressor 14, in which the lifting element 31 and the further lifting element/s 31 are configured as a separate piece, wherein the lifting elements 31 and the shaft 4 are connected with each other in a torque transmitting manner by a connecting force 94 acting in the direction A of the axis 17 of the shaft 4. The force 94 is provided by biasing means 90, 92 biasing the shaft 4 and the lifting elements 31 in the direction A of the axis 17 of the shaft 4 against each other. The biasing means comprise a threaded nut 90 cooperating with a corresponding thread 92 on the shaft 4. Each of the lifting elements 31 are disc shaped and comprise a bore 114 a for receiving the shaft 4. The bores 114 of the lifting elements 31 are aligned to each other in that that the shaft 4 can be inserted in the direction of the axis of the shaft 4 through the bores 114. Thereby, each lifting element 31 can be previously preassembled in a crank case 81 of the compressor 14 in that they are already coupled with the pistons 21. The compressor further comprises a ring shaped shoulder 96 providing an abutment surface 116 protruding in radial direction, with respect to the axis of the shaft, from the shaft to allow transmitting the connecting force 94 from the shaft 4 to the lifting elements 31.

Due to the fact that the lifting elements 31 are separate elements, they can be individually pre-assembled to the pistons 21 outside of the crank case 81 which allows a strong fitting, in particular press fitting, between the connecting rods 33 and the lifting elements 31, in particular via roller bearings 36 connecting the lifting elements 31 with the pistons via the connecting rod 33. Further, thanks to the lifting elements being separate parts, they can be inserted into the crank case via piston openings, in particular bores 85, in the crank case 81. This particularly allows to combine the advantages of pre-assembling the pistons 21 and the lifting elements 31 outside of the crank case 81 with a one-piece crank case 81. The torque transmission from a motor, in particular electric motor, to the shaft 4 can be provided by coupling, for instance by a clutch 118.

In an alternative embodiment, the crank case can be a split crank case, which is illustrated by the cutting lines 120 and 122 in FIG. 5. Split line 120 illustrates an embodiment, in which the split line extends in axial direction A. Split line 122 illustrates an alternative embodiment, in which the split line extends in radial direction R. Along the split line 120, 122, the separate parts of the crank case can be connected with each other. By selecting the split lines for example as illustrated by the split lines 120 and 122, a pre-assembled crank drive comprising the shaft 4, the lifting elements 31, the connecting rods 33 and the pistons 21 can be inserted via a mounting opening into one of the separate parts of the crank case. This allows to preassemble the complete crank drive with multiple pistons 21 outside of the crank case 81 and/or to configure multiple lifting elements 31 in one peace while still enabling an easy assembling of the compressor 14.

The features disclosed in the above description, the figures and the claims might be significant for the realization of the invention in its different embodiments individually as in any combination.

REFERENCE SIGNS

1 piston
2 compressor cylinder
3 compressor chamber
4 shaft
5 axis
6 lifting element
7 connection element
8 space
9 intermediate element
10 axle of compressor cylinder
11 space
12 sleeve
13 lifting element
14 compressor
15 roller bearings
17, 55 rotation axis
19 compressor unit
21 piston
23 cylinder
25 crank mechanism
27 rotational movement
29 reciprocating movement
31 eccentric
33 connecting rods/conrods
35 flywheel
36 roller bearing
37 rotating mass forces
39 alternating mass force of the piston
40 orthogonal force component
41 parallel force component
43 center of gravity of the flywheel
45 rotating mass forces
77 center of gravity of the eccentric
79 superimposed force
81 crank case
83 housing
85 bore
89 mounting opening
90 threaded nut
91 cover
92 thread
94 compression force
95 air filter
96 ring-shaped shoulder
97 air flow
99 filter cover
101, 103 openings (bores)
105 discharge-channel system
107 collecting channel
108 cooling fins
109 individual discharge channel
111 cylinder head (cover)
114 bore
116 abutment surface
118 clutch
120, 122 cutting lines
R radial direction
A axial direction
U circumferential direction

The invention claimed is:

1. A piston compressor, comprising:
a piston guided in a compressor cylinder, wherein the piston and the compressor cylinder form a compressor chamber for compressing a fluid;
a shaft provided so as to rotate around its axis; and
a lifting element arranged eccentrically to the axis of the shaft and provided fixed to the shaft, wherein
the lifting element and the piston are configured such that the piston performs a movement between a maximum and a minimum lifting position when the shaft rotates around its axis,
the compressor further comprises at least one further piston guided in a further compressor cylinder,
the at least one further piston connected, directly or via further intermediate elements, to a further lifting element for each at least one further piston arranged on the shaft such that the at least one further piston is configured to perform a movement between a maximum and a minimum lifting position when the shaft rotates around its axis,
a space that provides cooling is provided between the lifting element and the further lifting elements, and
the space houses a cooling fluid therewithin,
the shaft has a cylindrical shape and the lifting element has a hollow cylindrical shape, an inner diameter of the hollow cylindrical shaped lifting element corresponds to an outer diameter of the shaft, and an outer diameter of the hollow cylindrical shaped lifting element corresponds to an inner diameter of bearings for coupling the lifting element with the intermediate elements and the further intermediate elements, and
the lifting element and the further lifting element are arranged so as to abut each other in the axial direction of the shaft.

2. The compressor according to claim 1, wherein
the lifting element and the piston are directly connected to each other or are connected via intermediate elements.

3. The compressor according to claim 1, wherein
the compressor comprises at least two further pistons, each further piston being guided in a further compressor cylinder.

4. The compressor according to claim 3, wherein
the compressor cylinder and the further compressor cylinders are arranged in an angular arrangement,
an angle between axes of the compressor cylinders is between 60° and 120°.

5. The compressor according to claim 1, wherein
the compressor cylinder and the further compressor cylinder are arranged such that a distance between axes of the compressor cylinder and the further compressor cylinder in the direction of the axis of the shaft:
(i) is smaller than a sum of outer radiuses of the compressor cylinder and the further compressor cylinder, and/or
(ii) is larger than an extension of each intermediate element coupling the piston with the shaft.

6. The compressor according to claim 1, wherein
the compressor cylinder and the further compressor cylinder are arranged in a row.

7. The compressor according to claim 1, wherein
the at least one further piston is connected directly or via the further intermediate elements to the further lifting element such that the at least one further piston is configured to perform a movement between a maximum and a minimum lifting position when the shaft rotates around its axis,
wherein an extension of the lifting element in a direction of the axis of the shaft is selected such that the piston and the at least one further piston are connectable to the lifting element and the further lifting element, wherein axes of the pistons are positioned spaced from each other in the direction of the axis of the shaft.

8. The compressor according to claim 7, wherein
each lifting element and the shaft are configured as one piece,
the shaft has a cylindrical shape, and/or
the lifting element has a disc shape or a cylindrical shape.

9. The compressor according to claim 1, further comprising:
a split crank case with two separate parts that are connectable with each other along a connecting surface,
wherein, before connecting the separate parts with each other, a mounting opening that is delimited by the connecting surface is dimensioned such that a pre-assembled crank drive comprising the shaft, the lifting element and the piston, is insertable via the mounting opening into one of the two separate parts.

10. The compressor according to claim 9, wherein
(i) the connecting surface extends parallel to the direction of the axis of the shaft, wherein at least one of the cylinders is coupled to one of the separate parts while the remaining cylinder/s are connected to the other part, or
(ii) the connecting surface extends perpendicular to the axis of the shaft, wherein the connecting surface cuts each cylinder opening in the crank case of each cylinder into two parts.

11. The compressor according to claim 1, wherein
each of the lifting element and the further lifting element are configured as a separate piece,
the lifting elements and the shaft are connected with each other in a torque transmitting manner by a connecting force acting in the direction of the axis of the shaft, and
the connecting force is provided by biasing the shaft and the lifting elements in the direction of the axis of the shaft against each other.

12. The compressor according to claim 11, wherein
each of the lifting elements comprise a bore for receiving the shaft,
the bores of each lifting element are aligned to each other in that that the shaft, being cylindrically shaped, is insertable in the direction of the axis of the shaft through the bores when each lifting element is already preassembled in a crank case of the compressor in that they are already coupled with the pistons, and
further comprising an abutment surface protruding in a radial direction, with respect to the axis of the shaft, from the shaft to allow transmitting the connecting force from the shaft to the lifting elements.

13. The compressor according to claim 1, wherein
the lifting elements are arranged eccentrically to the axis of the shaft, and are provided fixed to the shaft,
the lifting elements are aligned with each other in that an angle between the symmetry axis of the lifting elements is less than 180°.

14. The compressor according to claim 1, wherein
the piston is connected to the lifting element via a connection rod,
the lifting element comprises a circular disc, which is eccentrically provided to the shaft regarding its axis,
a roller bearing or a slide bearing is provided between the lifting element and the piston, and/or
the fluid is a gas or a liquid.

15. A vehicle, comprising:
a compressor according to claim 1, and
(i) wherein the compressor is configured to supply air to at least one of the following systems of the vehicle:
a fuel cell,
a pneumatic braking system,
an air suspension,
a compressed air reservoir, and/or
(ii) wherein the vehicle is configured as a commercial vehicle, a truck, a trailer, a passenger car, and/or a combination of a towing vehicle and a trailer, and/or
(iii) wherein the vehicle is configured as an electric, hybrid or conventional vehicle.

* * * * *